United States Patent [19]

Benner

[11] 4,323,265

[45] Apr. 6, 1982

[54] CROSS COUNTRY SKI

[75] Inventor: Wolfgang Benner, Kirchberg, Fed. Rep. of Germany

[73] Assignee: Benner Ski KG, Kirchberg, Fed. Rep. of Germany

[21] Appl. No.: 22,350

[22] Filed: Mar. 20, 1979

[30] Foreign Application Priority Data

Jun. 6, 1978 [DE] Fed. Rep. of Germany ..... 2824714

[51] Int. Cl.[3] ..... A63C 7/06

[52] U.S. Cl. ..... 280/604

[58] Field of Search ..... 280/604, 609, 601

[56] References Cited

FOREIGN PATENT DOCUMENTS

| | | | |
|---|---|---|---|
| 184858 | 3/1956 | Austria | 280/604 |
| 731285 | 2/1943 | Fed. Rep. of Germany | 280/604 |
| 1954075 | 5/1971 | Fed. Rep. of Germany | 280/604 |
| 2361663 | 6/1975 | Fed. Rep. of Germany | 280/604 |
| 808359 | 11/1936 | France | 280/604 |
| 89238 | 3/1957 | Norway | 280/604 |

*Primary Examiner*—Joseph F. Peters, Jr.
*Assistant Examiner*—Milton L. Smith
*Attorney, Agent, or Firm*—Shlesinger, Arkwright, Garvey & Dinsmore

[57] ABSTRACT

A cross country ski having a running surface profiled at least in the middle area of the length of the ski by a plurality of indentations in a fish scale-like pattern and arranged in transverse offset rows, the indentations having curved or arcuate leading edges and bottom surfaces arranged such that the deepest portion of the indentations is adjacent the apex of the curve, and the bottom surfaces may have several different configurations or profiles.

12 Claims, 20 Drawing Figures

CROSS COUNTRY SKI

This invention relates to a cross country ski with a profiled running surface at least in a middle area of the length of the ski, of which the profiling consists of series of transverse rows of indentations in a fish scale pattern, which rows are offset from each other, and which indentations have curved edges with the curve toward the tip of the ski, and the bottom surfaces of the indentations run relative to the running surface place such that the edges have their greatest depths in the area of the apex of the curve.

A cross country ski of this construction is known from French Pat. No. 808,359, in which the profiling is formed on both sides of a midline guide groove by indentations arranged in a fish scale pattern with curved edges directed forward, whereby the indentations are arranged adjacent to each other in transverse rows and are offset relative to each other in each subsequent row. Since the edges of the adjacent indentations in transverse and longitudinal direction engage directly on one another, with this profiling there remains only a small portion of the surface lying in the running surface plane, so that this cross country ski may theoretically offer a satisfactory climbing and bracing capacity, but only a moderate glide speed capacity.

On the other hand, in German Pat. No. 1,578,922, a known cross country ski is provided on the running surface with a layer of fish scales of the same type, in which the curved edges of the fish scales are directed toward the end of the ski, and also ascend in this direction. The curved edges of the fish scale projections arranged one next to the other in transverse rows join directly at their sides and thereby form grooves or notches tapering forward to the point, which determine the climbing capacity of this cross country ski, since the essentially transverse curved edges running rearward are flattened from the beginning during manufacture or through wear during use. A cross country ski with this running surface profiling has relatively good glide properties, but does not completely satisfy the climb and bracing properties. Therefore the fish scale profiling formed by such projections, with use, is subject to remarkable wear, and after a certain period of usage, the climb property is even further reduced.

The object of the invention is a cross country ski with a profiled running surface of the aforementioned type, constructed so that it guarantees an improved bracing and climbing capacity for the most part independent of the condition of the snow and the ambient temperature, without forfeiting good forward glide properties.

This object is attained in the invention in that the bottom surface of each indentation consists of sections with different inclination or curvature, such that at least the area of the edge adjacent to the apex of the curve has indentations of nearly the same depth as the apex of the curve.

The invention proceeds from the knowledge that the climb properties are influenced differently by the level or depth of the edge not only as presently at the front apex of the curve, but also by the areas to the sides adjacent to the apexes which also should be nearly as deep as the apex of the curve and consequently the bottom surfaces must be so configured that at least in the areas of the indentations controlling the bracing, greater snow volumes can be received, so that even when more or less filled with snow, a part of the edge remains available for the bracing.

If the bottom surfaces of the indentations have a front horizontal area running transverse to the ski length and an area extending in a curve rearward to the running surface plane, the wider border edge appears for improved climbing capacity, which edge has the necessary depth throughout this widened area. Simultaneously, directed behind the edges is found a deepened snow receiving space. This effect is reinforced if the rear areas of the bottom surfaces of the indentations are concave.

With convex curvature of the rear area of the bottom surface, the desired depth of snow receiving area is still found directly to the rear of the edge, but at the same time a part of the indentation is now provided with a gliding surface, which widens to the rear section of the glide surface to the level of the running surface plane. The indentations are thereby limited to the area of the curved edges, whereby it is preferable that narrow indentations which taper rearward still remain in the form of grooves behind or adjacent to the edges.

In order to improve the slide properties of a cross country ski of the disclosed profile, the surfaces forming the running surface plane between adjacent edges in transverse direction are widened into the curves. Thereby the glide surface extending into the forward curve does not need to be at the level of the running surface plane, but can be slightly indented in comparison with this, such that the bottom surfaces of the indentations can run between the curved edge and the gliding surface which is headed forward in the curve in the direction of a longitudinal middle rabbet at the front of the running surface plane ascending from both sides. The middle rabbet can be inclined downward and forward from the front end of the running surface plane between two adjacent curved bordering edges.

In another configuration of the invention, the curved edges can be arranged each to the rear of curved bulges arising from the running surface plane. These bulges can be easily produced of any desired suitable height, e.g., of one or more tenths of a millimeter, with the finishing of a thermoplastic coating, wherein a heated embossing roll is used for its manufacture, which carries the negative of the fish scale pattern to be formed in the plastic, and is powered with a controlled higher peripheral speed than the forward thrust of the plastic strip to be profiled.

Since the edges of the indentations which are side by side and one after the other in series of rows are approximately 1 to 4 mm apart, the bulges can be joined by a smaller spacing between the two side edges at the rear end, whereby they then fall off obliquely to the rear, to the running surface plane.

In another embodiment, the height of the curved edges is exceeded by the curved bulges arising out of the running surface. In this case, the cross country ski, or its surface coating, has an essentially flat gliding surface out of which project the curved bulges with the curved fish scale edges behind them. The bottom surfaces of the indentations limited at the sides and front by the edges are essentially on the level of the common running plane.

In order to avoid the danger that the climbing aids formed of the indentations or the curved edges be filled with snow and therefore be for the most part ineffective, it is suggested that longitudinal grooves be provided in the running surface, of which the regular depth corresponds approximately to the greatest depth of the indentations, and which extend continuously through the longitudinal midline of the indentations, beginning at the apex of the curve of an edge of a fish scale, and continuing through the space between the two edges of the rows of indentations to the next indentation which is longitudinally aligned with the first. On the basis of this disclosure, longitudinal grooves arise over the width of the running surface, side by side and extend the entire length of the running surface profiling, and thereby, in addition to keeping the indentations free of snow, also serve as a remarkable aid in holding the ski in alignment, and also eliminate the noise build-up which often arises with this type of profiling, which is traced back to the fact that air pockets in the chambers between the edges of the fish scales are compressed and strain to release the pressure. The longitudinal grooves simultaneously have the function of air passage, so that no entrapped air volumes can form from the beginning. Therefore these longitudinal grooves can partially or entirely replace the traditional middle groove found in the running surface.

The invention is henceforth more clearly described in relation to the embodiments shown in the drawings.

FIGS. 1*a*, 1*b* are diagrammatic planar views of the ski running surface, with profiling according to the present invention.

Figure 1A:
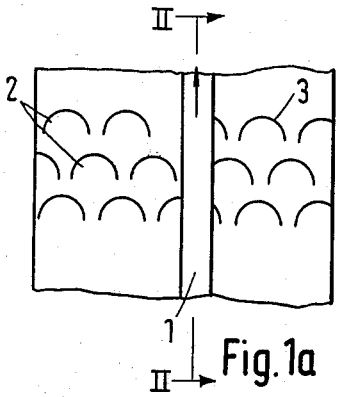
Figure 1B:
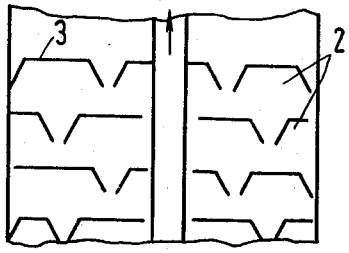
Figure 2:
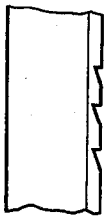
FIG. 2 is a diagrammatic longitudinal cross section through the ski along line II—II of FIG. 1*a*.

FIGS. 1*a* and 1*b* show different possibilities for the profiling of the running surface of a cross country ski, which is for example provided with a middle guide groove 1 and whereby the profiling either is provided on a running surface which is adhered thereto, preferably of thermoplastic material, or is of the underside of a completely plastic ski body. The profiling consists of transverse rows, offset from each other, of indentations 2, of a fish scale pattern, which are limited by essentially curved edges 3 positioned toward the ski point. FIG. 1*a* shows edges 3 in essentially semicircles, while FIG. 1*b* shows edges 3 in nearer to an open trapezoidal line, which are limited at the front by a transverse line. Indentations 2 or their edges 3 are arranged in a series of transverse rows with interstices. Although the following description of embodiments are based essentially on curved edges as in FIG. 1*a*, it is to be understood that the invention extends also to indentations with edges 3 corresponding to FIG. 1*b* or to any other essentially semicircle configuration.

Figure 3:
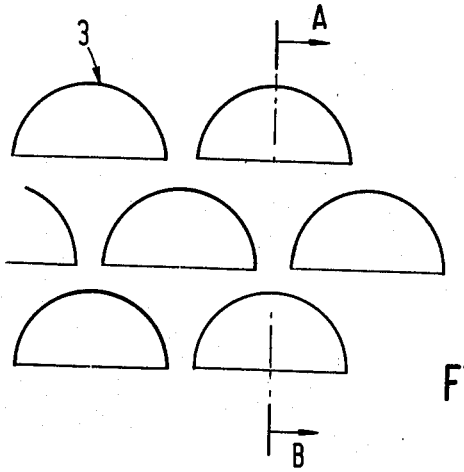
FIG. 3 is an enlarged planar view of a cutout of the running surface as in FIG. 1.
Figure 4:
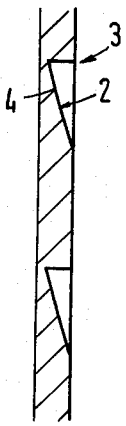
FIG. 4 is a longitudinal cross section along line A–B of FIG. 3, corresponding to the prior art.
Figure 5:
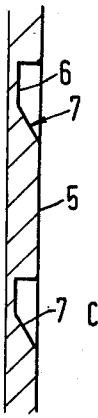
FIG. 5 is a cross section similar to that of FIG. 4 for one profiling according to the present invention.
Figure 6:
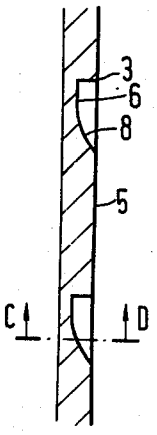
FIG. 6 is a cross section similar to that in FIG. 4 corresponding to a modification of the present invention.
Figure 7:
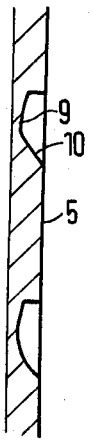
FIG. 7 is a cross section similar to that in FIG. 4, corresponding to another modification of this invention.
Figure 8:
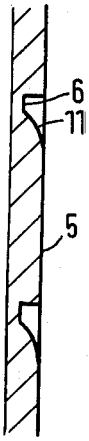
FIG. 8 is a cross section similar to that in FIG. 4, corresponding to another modification according to the present invention.

The indentations of the negative fish scale profile are preferably arranged as in FIG. 3, so that the edges 3 which are adjacent to each other in transverse rows and also in longitudinal direction have certain spacings between them. In the prior art as shown in FIG. 4, the bottom surfaces 4 of the indentations 2 run at such an angle to the running surface plane 5, that the edges have their greatest depth in the area of the apex of the curve. To obtain an improved climbing capacity with the cross country ski, FIGS. 5–8 show the bottom surfaces 4 configured not as flat inclined surfaces, but being made up of separate sections with different inclinations or curvatures, so that at least the areas which are adjacent to the apex of the curve have almost the same depths as at the apex of the curve. FIG. 5 shows the bottom surface including an area 6 which runs approximately horizontally transverse to the line of the ski and an inclined area 7 extending rearwards and adjoining the running surface plane 5. FIG. 6 shows that the rear of the bottom surface can have a concave section 8. In FIG. 7, the bottom surface of the indentations consists of a front bucket 9, to which are connected an either straight or convex area 10. The deepest point of the bucket lies at approximately $\frac{1}{3}$ to $\frac{1}{2}$ the length of the indentation. FIG. 8 shows a modification of FIG. 6 in that a front, essentially straight area 6, connects to a rear convex section 11.

Figure 9:
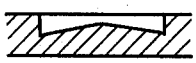
FIG. 9 is a cross section along line C–D in FIG. 6 showing the course of the bottom surface of the indentations according to another possible embodiment of the invention.
Figure 10:
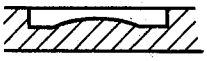
FIG. 10 is a similar cross section to that in FIG. 9, for a different profiling of the bottom surface of the indentations.

Particularly in the embodiment of FIG. 8, the glide surface extending forward into indentation 2 can be embodied also in transverse direction, as in FIGS. 9 or 10, arched so that the side areas of the edges are more pressed out, almost to their rear ends, or maintain a standard depth for the bracing and maintaining the alignment of the cross country ski.

Figure 11:
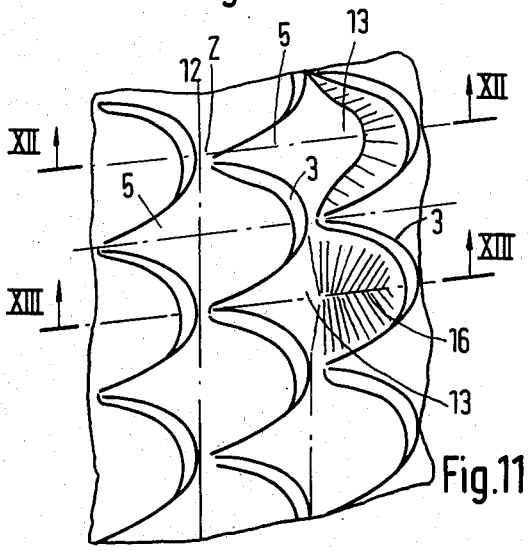
FIG. 11 is a perspective planar view of a running surface coating with a profiling according to the invention, wherein two possible configurations are shown for the bottom surface of the indentations.

The perspective representation shown in FIG. 11 shows two different embodiments for gliding surface areas widened forward into the curve in the same fish scale pattern. The glide surface sections 5, forming the running surface planes, are shown between edges 3 which are adjacent in transverse direction. Normally, these glide surfaces end approximately at the indicated line 12 and are at a certain distance from the spices of the curves of the edges to the rear.

In the top embodiment shown in FIG. 11, glide surface 5 is widened toward the front in the curve formed by the edge, with a curved section 13. The bottom surface of the indentations between the edge and the glide surface, which is widened to the front of the curve, is inclined slightly upwards from the apex of the curve out in longitudinal direction, approximately corresponding to the broken line 14 shown in FIG. 12. The connection between bottom surface 6 and the top glide surface 13 is created with more steeply inclined transition sections 15.

Figure 12:
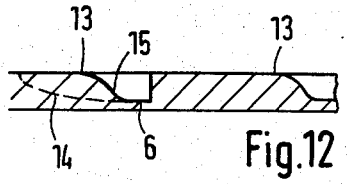
FIG. 12 is a vertical longitudinal cross section along line XII—XII of FIG. 11.
Figure 13:
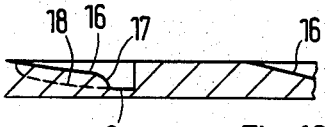
FIG. 13 is a vertical longitudinal cross section along line XIII—XIII of FIG. 11.

Similar relationships are given for the second embodiment shown at the bottom in FIG. 11, which is comparable to the vertical longitudinal cross section shown in FIG. 13. Here, section 13 of surface 5, which is extended into curve, is shorter, and a longitudinal middle rabbet extends from the front of the glide surface, and either remains at the level of the glide surface, or runs inclined slightly downward, as in FIG. 13, and connects with an inclined transition section 17 in the area 6 found to the rear of the apex of the curve. In FIGS. 12 and 13, the glide property of the cross country ski is improved by the enlarged glide surface sections 13, without the necessity of thereby relinquishing a good climb capacity, which furthermore is guaranteed by the indented bottom surface, which glide surface sections 13 exist particularly on the frontside of the curve and extend also to the bottom on the side ends of edges 3. Both basic embodiments, as in FIGS. 12 and 13, have commonly that the bottom surface and the inclined transition section 15 or 17 are at their widest in the area of the curve and decrease in size uniformly down to the curve ends.

Figure 14:
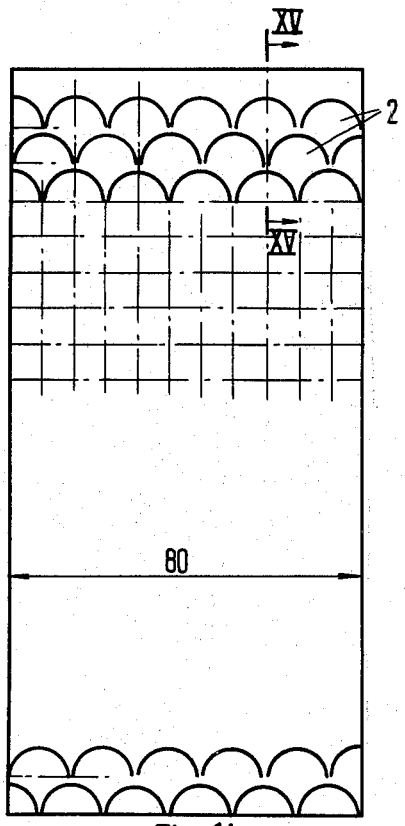
FIG. 14 is a planar view of a section of a running surface profiling in real dimensions.
Figure 15:
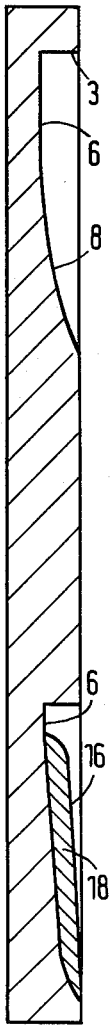
FIG. 15 is an enlarged cross section along line XV—XV of FIG. 14.

A similar embodiment is shown in FIGS. 14 and 15, where the running surface shown in FIG. 15 has no longitudinal middle groove, since it can normally be deleted if the edges which end in essentially longitudinal direction are sufficiently pressed out, and thus can incorporate a longitudinal guide function therewith. The enlarged longitudinal cross section in FIG. 15 shows a widened indentation as in FIG. 6, with a concave rear section 8, while the bottom indentation in FIG. 15 refers to a similar embodiment to that in FIG. 13, where the glide surface 5 is extended forward by a longitudinal middle rabbet 16, and surface areas 18 are provided from the bottom-most point of the bottom surface adjacent to the edge rising inward to the middle rabbet.

Figure 16:
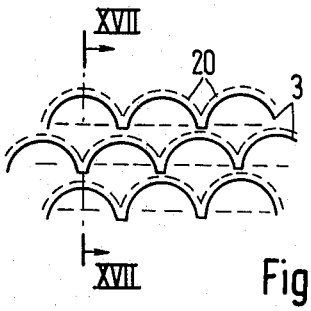
FIG. 16 is a diagrammatic planar view of the running surface of a cross country ski with a modified profiling.
Figure 17:
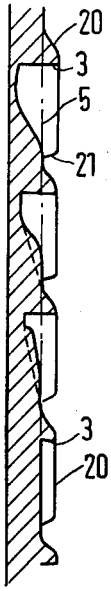
FIG. 17 is a vertical longitudinal cross section through a running surface as in FIG. 16 and along lines XVII—XVII of FIG. 16, with different possible profilings for the indentations and their edges.

FIG. 16 shows a planar view wherein curved edges 3 are each arranged on the backside of curved bulges 20 arising out of the surface plane. Proceeding therefrom, if the indentations can be of approximately 0.2 to 0.3mm depth, then in the longitudinal cross section of FIG. 17 it shows that the bulges 20 have a height of approximately 0.1mm above running surface plane 5. The bulges have smooth inclined transition sections which are inclined forward and which preferably, but not necessarily, extend over the entire length of an edge. In FIG. 16, the bulges 20 can join at the back of two adjacent side edges, whereby they are inclined rearward to the running surface plane at point 21. In FIG. 17, different configurations are shown from the top downward, although of these different configurations of course only one comes into use for any particular running surface coating. The configuration of the top indentation in FIG. 17 corresponds approximately to that of FIG. 7, the next approximately to that of FIG. 8, the next approximately to that of FIG. 13, and the bottom configuration shows no indentation at all and the height of the curve edges 3 is created by curved bulges 20 arising out of running surface. It is essential for all of these embodiments that the front transition areas of bulges 20 extend uniformly to running surface plane 5, as shown.

Figure 18:
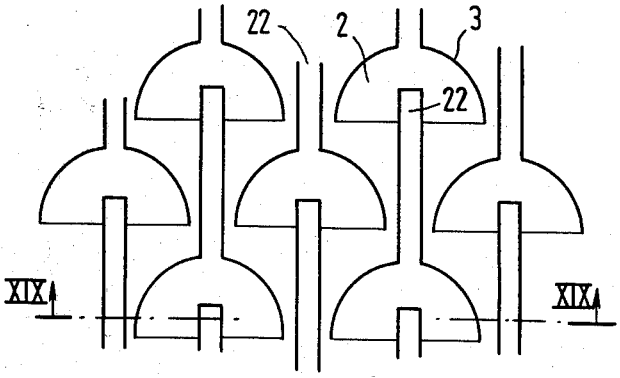
FIG. 18 is an enlarged planar view of a section of a running surface according to another embodiment of the invention and FIG. 18*a* is a side elevation thereof.
Figure 18A:
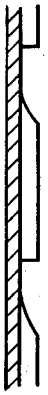
Figure 19:
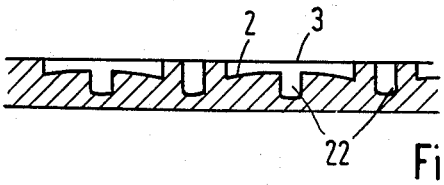
FIG. 19 shows a cross section along line XIX—XIX of FIG. 18.

FIG. 18 shows a profiling provided with longitudinal grooves 22, in which the longitudinal grooves have a common, uniform depth in relation to the common running surface plane, which corresponds approximately to the greatest depth of indentations 2. Longitudinal grooves 22 extend continuously through the longitudinal midline of the indentations and begin at the apex of the curve of an edge 3, and then continue into the next indentation, through the distance between two adjacent edges of the transverse rows of indentations, to the next indentation which is aligned with the first in longitudinal direction.

While this invention has been described as having a preferred design, it will be understood that it is capable of further modification. This application, is therefore, intended to cover any variations, uses, or adaptations of the invention following the general principles thereof and including such departures from the present disclosure as come within known or customary practice in the art to which this invention pertains, and as may be applied to the essential features hereinbefore set forth and fall within the scope of this invention or the limits of the claims.

What is claimed is:

1. A cross country ski having a running surface profiled along at least a central portion of the length thereof, the profiling comprising a plurality of indentations in a scale-like pattern, said indentations being arranged in transverse offset rows and having essentially curved edges with the apex of the curved edge toward the point of the ski, the bottom surfaces of the indentations extending in relation to the running surface plane such that said indentations have the greatest depth in the area of the apices of the curved edges, the bottom surfaces of said indentations having sections with different inclination such that at least the areas of the section adjacent to the apices of the curved edges have substantially the same depth as the apex of the curve, the bottom surface of each indentation having a front area transverse to the length of the ski comprising a bucket-shape (9) connecting to the apex of a curved edge (3), and wherein the deepest point is approximately $\frac{1}{3}$ to $\frac{1}{2}$ the length of said indentation, and wherein a straight or convex rear area on the bucket-shaped area connects to the running surface plane (5).

2. A cross country ski as in claim 1, wherein the bottom surface of the indentations have a horizontal area (6) transverse to the length of the ski and a convex rear area (7) connecting to the running surface plane.

3. A cross country ski having a running surface profiled along at least a central portion of the length thereof, the profiling comprising a plurality of indentations in a scale-like pattern, said indentations being arranged in transverse offset rows and having essentially curved leading edges with the apex of each leading edge directed toward the point of the ski, the bottom surfaces of the indentations extending in relation to the running surface plane such that said indentations have the greatest depth in the area of the apices of the leading edges, the bottom surfaces of said indentations having convex portions with different inclinations such that at least the areas of the section adjacent to the apices of the curved edges have substantially the same depth as the apex of the curve, and the effective area of said running surface is increased relative to a line connecting the rearmost points of said indentations.

4. A cross country ski as in claim 3, wherein said bottom surfaces (6, 14) are the widest in the area of the apex of the curve, and gradually decrease in width to the ends of the edges (3).

5. A cross country ski as in claim 3 and wherein each of said indentations includes a curved trailing edge directed toward the point of the ski and intersecting said leading edge so that said edges comprise the intersection of said indentations and said running surface.

6. A cross country ski as in claim 5, wherein the bottom surface of said indentations (2) originates along the trailing curved edge at the running surface (13) and extends forward in the curve, from a surface (14) rising slightly from the apex of the curve rearward, and extends in the direction of a longitudinal middle rabbet (16) connecting at the front to said running surface (13).

7. A cross country ski as in claim 6, wherein said middle rabbet (16) is inclined downward toward the point of said skis from said running surface (5, 13) between adjacent curved leading edges.

8. A cross country ski as in claim 6 or 7, wherein said middle rabbet (16) ends before an indented area (6) of the bottom surface found behind the apex of the curved edge and is connected thereto by an inclined transition section (17) (FIG. 13).

9. A cross country ski as in claim 3, wherein the curved leading edges (3) are arranged on the backside of curved bulges (20) arising out of the running surface.

10. A cross country ski as in claim 9, wherein said bulges (20) are combined between two adjacent edges (3) at the rear end and are inclined rearward to the running surface plane (21) (FIG. 17).

11. A cross country ski as in claim 9 or 10, wherein the height of the curved edges is prevalently defined by said curved bulges (20) arising out of the running surface (FIG. 17).

12. A cross country ski as in claim 3, wherein longitudinal grooves (22) are provided in the running surface and extend continuously through the longitudinal midline of the indentations, beginning at the apex of the curve of a leading edge and proceeding forward into the next indentation, through the distance between two adjacent edges of the transverse rows of indentations, which next indentation is longitudinally aligned with the first indentation the average depth of the grooves corresponding approximately to the greatest depth of the indentations.

* * * * *